US011008785B2

(12) United States Patent
Perez et al.

(10) Patent No.: US 11,008,785 B2
(45) Date of Patent: May 18, 2021

(54) DUAL PULL LATCH ASSEMBLY

(71) Applicant: Inteva Products, LLC, Troy, MI (US)

(72) Inventors: Sinai Perez, Chihuahua (MX); Eduardo Estrada, Chihuahua (MX); Manuel Escamilla, Chihuahua (MX); Donald M. Perkins, Sterling Heights, MI (US); Luis Vazquez, Chihuahua (MX); Carlos Tostado, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 606 days.

(21) Appl. No.: 15/832,305

(22) Filed: Dec. 5, 2017

(65) Prior Publication Data

US 2018/0202200 A1 Jul. 19, 2018

Related U.S. Application Data

(60) Provisional application No. 62/430,851, filed on Dec. 6, 2016.

(51) Int. Cl.

| | |
|---|---|
| ***E05B 79/20*** | (2014.01) |
| ***E05B 79/22*** | (2014.01) |
| ***E05B 77/22*** | (2014.01) |
| ***E05B 77/30*** | (2014.01) |
| *E05B 83/24* | (2014.01) |

(52) U.S. Cl.

CPC ..... *E05B 79/20* (2013.01); *E05B 77/22* (2013.01); *E05B 77/30* (2013.01); *E05B 79/22* (2013.01); *E05B 83/24* (2013.01)

(58) Field of Classification Search

CPC ..... E05B 79/20; E05B 79/22; E05B 77/30; E05B 83/24

USPC ..... 292/336.3

See application file for complete search history.

(56) References Cited

U.S. PATENT DOCUMENTS

| | | | | | |
|---|---|---|---|---|---|
| 3,993,338 | A | * | 11/1976 | Cherbourg | B60J 5/06 292/336.3 |
| 4,346,925 | A | * | 8/1982 | Okada | E05B 79/20 292/336.3 |
| 4,526,057 | A | * | 7/1985 | Mochida | E05B 53/005 292/336.3 |
| 4,544,189 | A | * | 10/1985 | Fiordellisi | E05B 79/20 292/336.3 |
| 4,633,724 | A | * | 1/1987 | Mochida | E05B 53/005 296/76 |
| 4,691,584 | A | * | 9/1987 | Takaishi | E05B 81/06 292/144 |

(Continued)

FOREIGN PATENT DOCUMENTS

| | | | | | |
|---|---|---|---|---|---|
| DE | 102006024860 | A1 | * | 11/2007 | F16C 1/10 |
| EP | 757147 | | * | 2/1997 | |

(Continued)

*Primary Examiner* — Carlos Lugo

(74) *Attorney, Agent, or Firm* — Cantor Colburn LLP

(57) ABSTRACT

A dual pull latch assembly and method of unlatching a panel. The double cable pull assembly includes a pull rod, a selector lever, and a linkage, wherein the selector lever is selectively disposed in a first feature or second feature of the linkage. In another embodiment, the double pull latch assembly includes a release arm, a lever, and a hold open lever to hold the lever in the intermediate position.

12 Claims, 8 Drawing Sheets

(56) References Cited

U.S. PATENT DOCUMENTS

| | | | | | |
|---|---|---|---|---|---|
| 5,681,068 | A * | 10/1997 | Kleefeldt | ..... | E05B 13/005 292/336.3 |
| 5,775,764 | A * | 7/1998 | Yamashita | ..... | E05B 79/20 296/76 |
| 6,598,912 | B2 * | 7/2003 | Hillgaertner | ..... | E05B 13/005 292/225 |
| 9,316,020 | B2 * | 4/2016 | Lee | ..... | E05B 1/003 |
| 2017/0268263 | A1 * | 9/2017 | Dow | ..... | E05B 77/22 |

FOREIGN PATENT DOCUMENTS

| | | | | | |
|---|---|---|---|---|---|
| EP | 2980341 | A1 * | 2/2016 | ..... | E05B 15/04 |
| FR | 2963944 | A1 * | 2/2012 | ..... | E05B 15/04 |
| JP | 2015086523 | * | 5/2015 | | |

* cited by examiner

DUAL PULL LATCH ASSEMBLY

CROSS REFERENCE TO RELATED APPLICATIONS

This application claims the benefit of U.S. Provisional Patent Application Ser. No. 62/430,851 filed on Dec. 6, 2016, the contents of which are incorporated herein by reference thereto.

BACKGROUND

The present disclosure relates to latches for vehicles, and more particularly to latches that require multiple actions in order to be released.

Latches can be utilized in vehicles to selectively retain and release panels of the vehicle. During operation, unintended or accidental release of certain panels, such as a hood of the vehicle, may reduce visibility or damage the vehicle during operation.

Accordingly, it is desirable to provide latch assemblies that prevent unintended or accidental release of vehicle panels.

BRIEF SUMMARY

According to an embodiment, a double cable pull assembly includes a pull rod configured to translate between a first position and a second position, a selector lever having a selector lever end, wherein the selector lever is rotatably attached to the pull rod, a linkage with a first feature and a second feature, wherein the selector lever end is selectively disposed in the first feature or the second feature, a first cable attachment to receive a first cable, wherein the first cable attachment is coupled to the pull rod when the selector lever end is disposed in the first feature of the linkage, and a second cable attachment to receive a second cable, wherein the second cable attachment is coupled to the pull rod when the selector lever end is disposed in the second feature of the linkage.

In addition to one or more of the features described above, or as an alternative, further embodiments could include a pull rod spring associated with the pull rod to urge the pull rod to the first position.

In addition to one or more of the features described above, or as an alternative, further embodiments could include a selector lever pivot to rotatably couple the selector lever to an end of the pull rod.

In addition to one or more of the features described above, or as an alternative, further embodiments could include that the linkage includes a linkage profile to guide the selector lever end.

In addition to one or more of the features described above, or as an alternative, further embodiments could include that the first cable attachment includes a first cable attachment engagement feature to receive the selector lever end.

In addition to one or more of the features described above, or as an alternative, further embodiments could include that the second cable attachment includes a second cable attachment engagement feature to receive the selector lever end.

In addition to one or more of the features described above, or as an alternative, further embodiments could include a return spring associated with the linkage to rotate the linkage to a first position.

According to an embodiment, a double pull latch assembly includes a release arm is configured to rotate from a first position, a lever associated with the release arm, wherein rotation of the release arm rotates the lever between a resting position, an intermediate position, and a release position, a hold open lever to selectively hold the lever in the intermediate position, and a release latch having a locked state and an unlocked state, wherein the release latch is placed in the unlocked state when the lever rotates to the release position.

In addition to one or more of the features described above, or as an alternative, further embodiments could include that the release arm includes a cable attachment pivot to receive a pull cable.

In addition to one or more of the features described above, or as an alternative, further embodiments could include a release arm ratchet to selectively limit rotation of the release arm.

In addition to one or more of the features described above, or as an alternative, further embodiments could include that the release arm ratchet is toggled by a ratchet engagement protrusion.

In addition to one or more of the features described above, or as an alternative, further embodiments could include that the hold open lever includes a protrusion to receive the lever in the intermediate position.

In addition to one or more of the features described above, or as an alternative, further embodiments could include that the hold open lever rotates about a hold open pivot.

In addition to one or more of the features described above, or as an alternative, further embodiments could include a pawl associated with the release latch, wherein the lever disengages the pawl from the release latch when the lever is in the release position.

In addition to one or more of the features described above, or as an alternative, further embodiments could include that the pawl includes a spring to urge the pawl to a locked position to retain the release latch.

Other aspects, features, and techniques of the embodiments will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Embodiments of the present disclosure provide a double pull latch assembly for use with a vehicle. The double pull latch assembly provides a selectively releasable latch while preventing inadvertent release by requiring the user to perform multiple actions or at least two actions to allow for release of the latch.

Figure 1A:
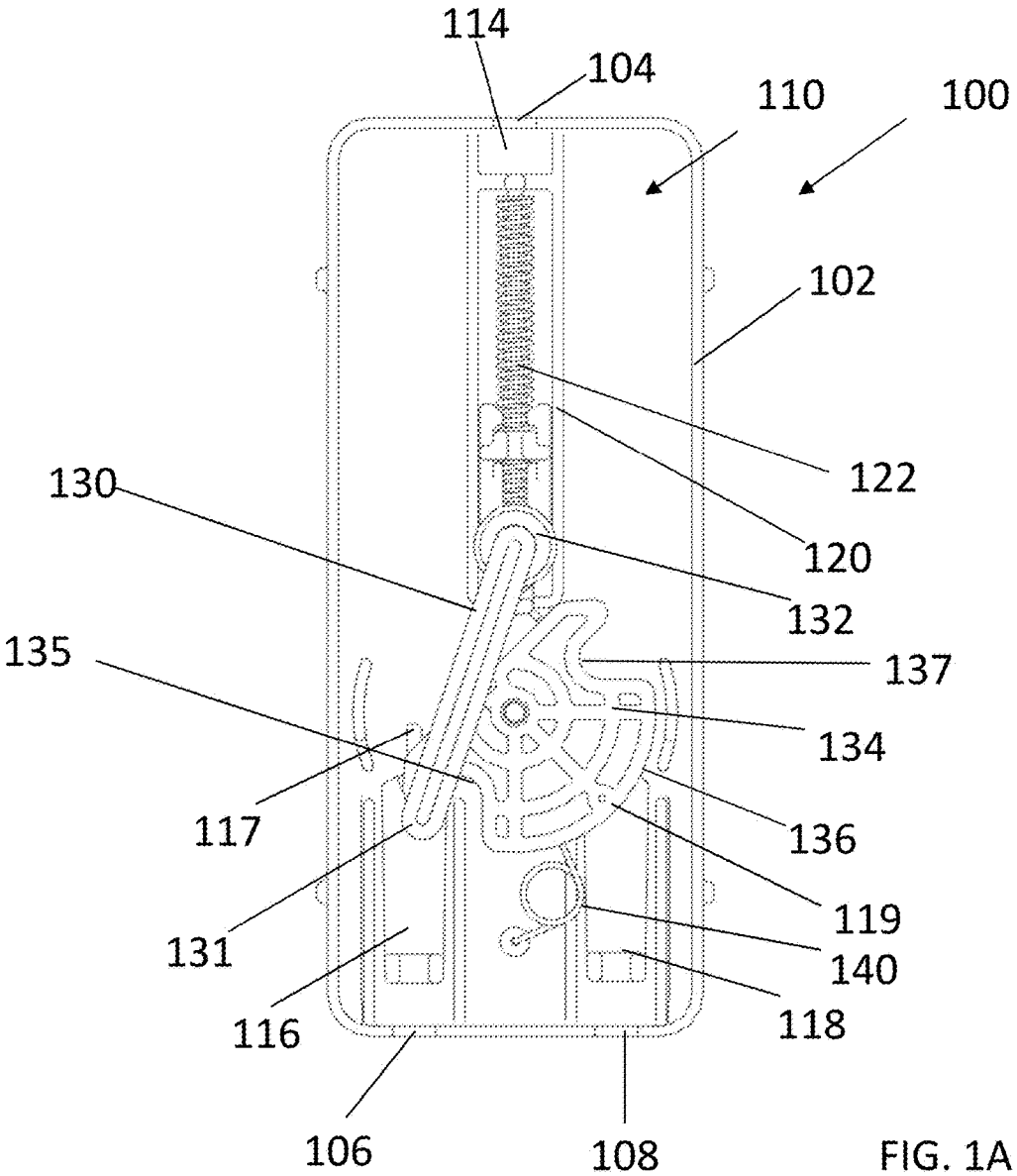
FIG. 1A is a cross sectional view of a portion of a double cable pull assembly in accordance with the present disclosure shown in a resting position.

Referring to FIG. 1A, a double cable pull assembly 100 is shown. In the illustrated embodiment, the double cable pull assembly 100 includes a housing 102 and a release mechanism 110 that includes a pull rod 120, a selector lever 130 and a linkage 134. In the illustrated embodiment, the double cable pull assembly 100 can be utilized to actuate a first cable operated latch and a second cable operated latch by pulling a single cable twice. In certain embodiments, the double cable pull assembly can be utilized with latches similar to the double pull latch assembly 200 shown in FIGS. 2A-2D.

In the illustrated embodiment, the pull rod 120 includes a pull cable attachment 114 and a pull rod spring 122. In the illustrated embodiment, the pull rod 120 can receive a pulling force from a pull cable actuated by a user or any other source and translate the force to the selector lever 130. In certain embodiments, the pull rod 120 can be referred to as a release arm.

In the illustrated embodiment a pull cable can attach to the pull rod 120 via the pull cable attachment 114. In the illustrated embodiment, the pull rod 120 can be actuated to move from a first (resting) position to a second position by a user pulling the pull cable in a vehicle cabin or in any other suitable location. In the illustrated embodiment, the pull rod 120 can be urged to a resting position by the pull rod spring 122.

In the illustrated embodiment, as the pull rod 120 is translated by the user via a pull cable, the selector lever 130 can be urged upwardly with the pull rod 120. In the illustrated embodiment, the selector lever 130 includes a selector pivot 132 and a selector lever end 131. In the illustrated embodiment, the selector lever 130 is coupled to the pull rod 120 via the selector pivot 132. In the illustrated embodiment, the selector pivot 132 can be any suitable pivot to allow the selector lever 130 to rotate relative to the pull rod 120. In the illustrated embodiment, the selector lever 130 can selectively engage the first cable attachment 116 or the second cable attachment 118 to allow the user to pull the first cable and then the second cable by pulling the pull cable twice.

In the illustrated embodiment, the selector lever end 131 can be guided by features of the linkage 134 to rotate and engage the first cable attachment 116 or the second cable attachment 118. In the illustrated embodiment, the linkage 134 includes a profile 136, a first feature 135, and a second feature 136.

In the illustrated embodiment, the selector lever end 131 can travel along the profile 136 to be guided to either the first feature 135 or the second feature 137. In the illustrated embodiment, the first feature 135 and the second feature 137 are features or indentations that can receive the selector lever end 131.

In the illustrated embodiment, as the selector lever end 131 engages the first feature 135, the selector lever end 131 is guided to engage the first cable attachment 116. In the illustrated embodiment, the selector lever end 131 can engage the cable attachment end 117 of the first cable attachment 116. In the illustrated embodiment, the cable attachment end 117 is a feature that can receive the selector lever end 131. When the selector lever end 131 is engaged to the cable attachment end 117, translation of the pull rod 120 can pull the selector lever 130 and pull the cable attachment 116. In the illustrated embodiment, this can pull the first cable attachment 116 and any cable attached thereto.

Similarly, in the illustrated embodiment, as the selector lever end 131 engages the second feature 137, the selector lever end 131 is guided to engage the second cable attachment 118. In the illustrated embodiment, the selector lever end 131 can engage the cable attachment end 119 of the second cable attachment 118. In the illustrated embodiment, the cable attachment end 119 is a feature that can receive the selector lever end 131. When the selector lever end 131 is engaged to the cable attachment end 119, translation of the pull rod 120 can pull the selector lever 130 and pull the second cable attachment 118. In the illustrated embodiment, this can pull the second cable attachment 118 and any cable attached thereto. In the illustrated embodiment, the linkage 134 can be returned to an initial position by the return spring 140.

In the illustrated embodiment, the release mechanism 110 is contained in a release housing 102. In the illustrated embodiment, the housing 102 includes a pull cable opening 104 to allow the pull cable to pass therethrough to engage to the pull cable attachment 114. Further, the housing 102 includes a first cable opening 106 to allow a first cable to pass therethrough to engage the first cable attachment 116. Similarly, the housing 102 includes a second cable opening 108 to allow a second cable to pass therethrough to engage the second cable attachment 118.

Referring to FIG. 1A, the release mechanism 110 is shown in an initial resting position. In the initial position, the selector lever end 131 is disposed in the first feature 135 of the linkage 134. As a result, the selector lever 130 is engaged with the cable attachment end 117 of the first cable attachment 116.

Figure 1B:
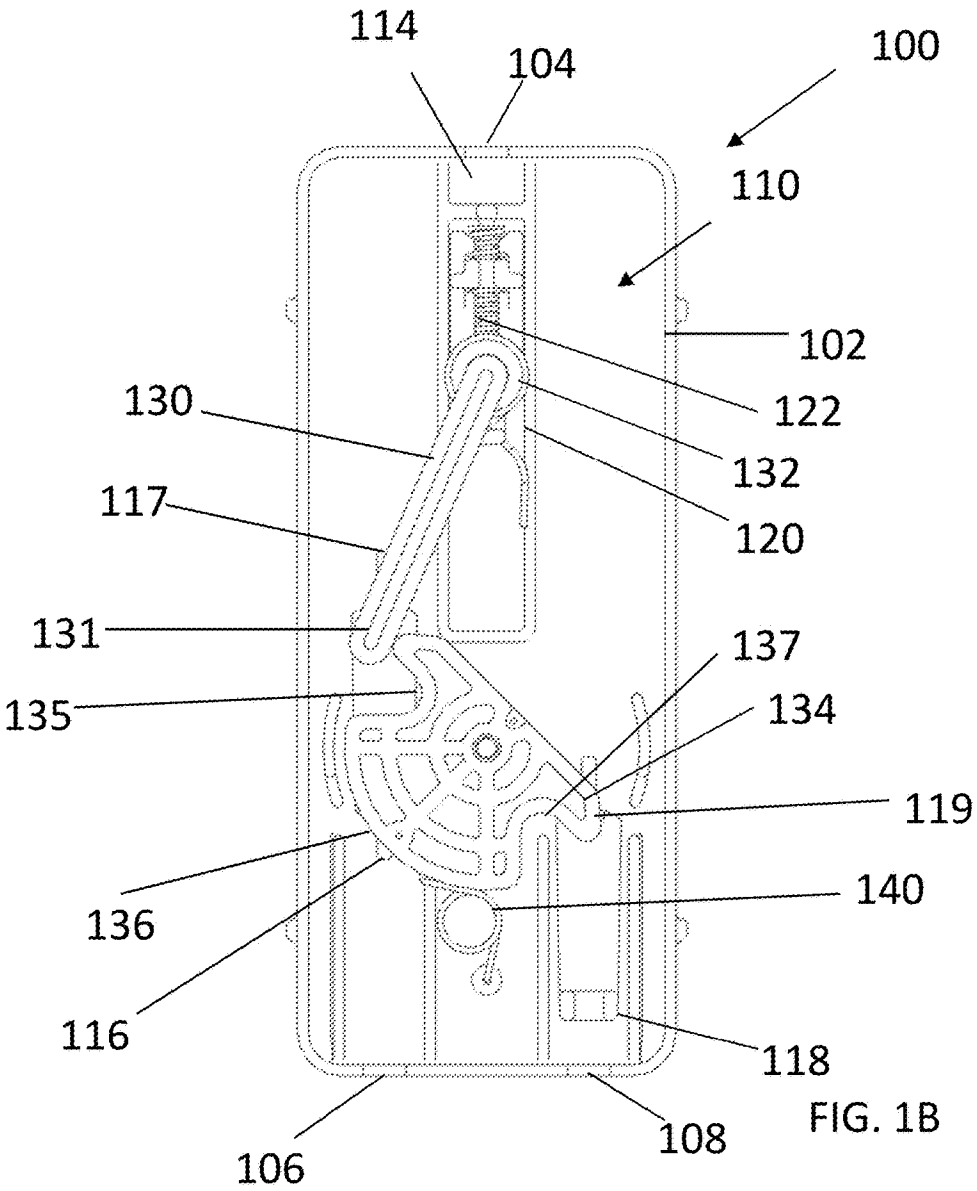
FIG. 1B is a cross sectional view of the double cable pull assembly of FIG. 1A shown engaging a first cable.

Referring to FIG. 1B, a user or any other suitable actuator can pull a pull cable to pull the pull cable attachment 114 of the pull rod 120. As the pull rod 120 is translated upwardly, the pull rod spring 122 is compressed. In the illustrated embodiment, the selector lever 130 is engaged to the cable attachment end 117 of the first cable attachment 116. As the selector lever 130 is pulled upwardly, the cable attachment end 117 is pulled upwardly due to engagement with the selector lever end 131. Therefore, a first cable attached to the first cable attachment 116 is pulled. In certain embodiments, the first latch attached thereto can be actuated by the first pull of the pull cable.

Figure 1C:
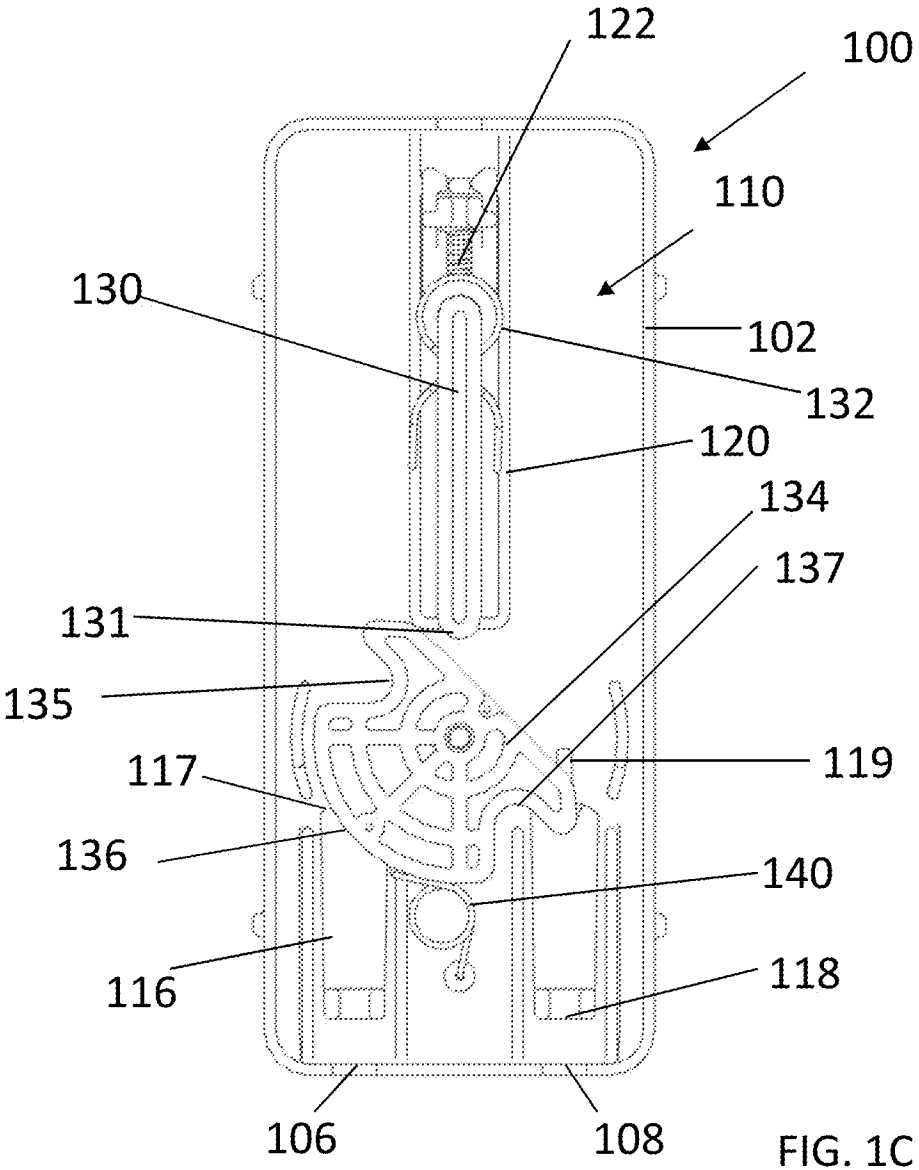
FIG. 1C is a cross sectional view of the double cable pull assembly of FIG. 1A shown in a released position after the first cable is engaged.

Referring to FIG. 1C, the release mechanism 110 is shown after the first pull of the pull cable is completed. In the illustrated embodiment, the selector lever 130 has rotated to an intermediate position. As the pull rod 120 is released, the selector lever end 131 can slide along the upper portion of the profile 136 of the linkage 134.

Figure 1D:
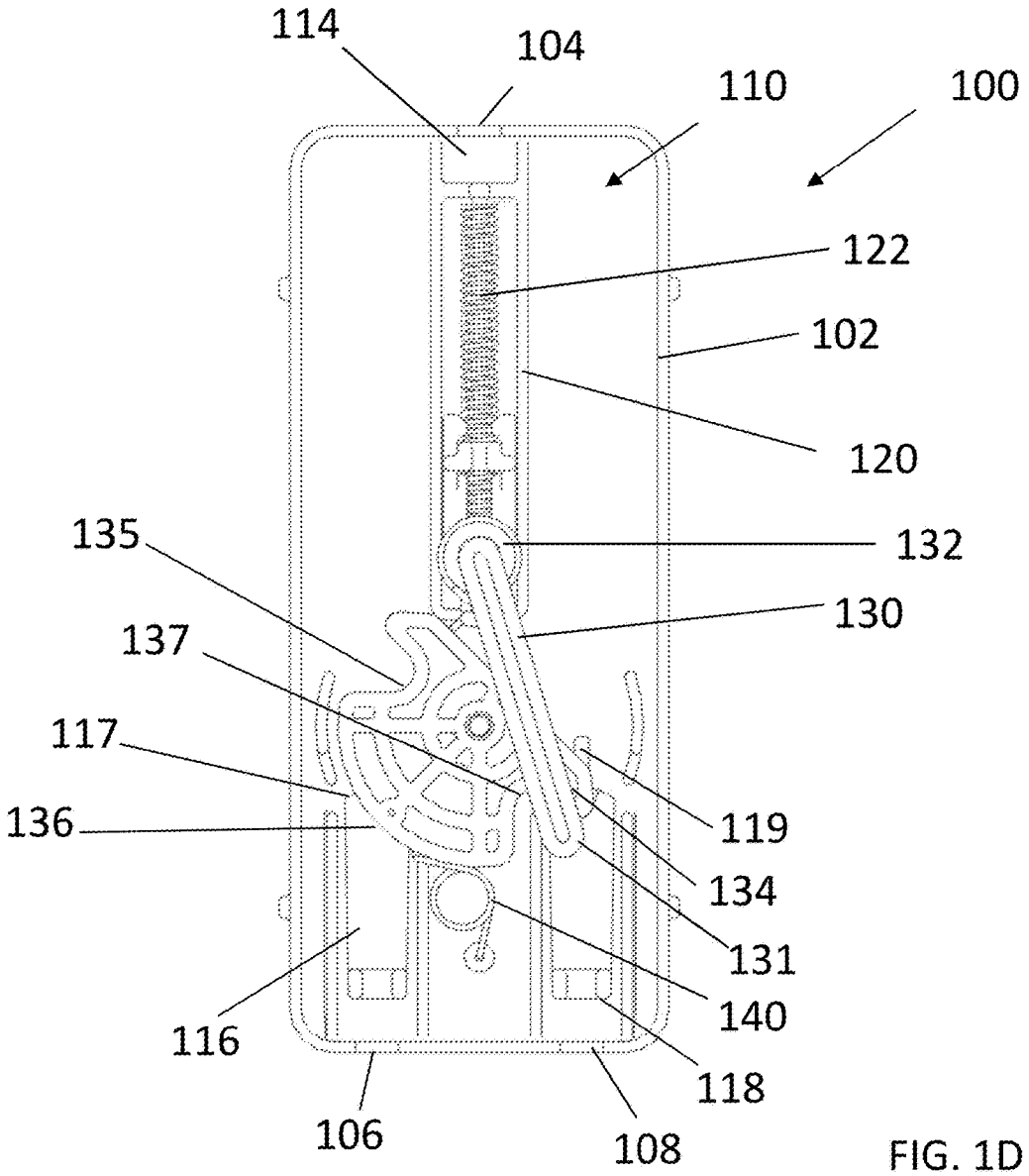
FIG. 1D is a cross sectional view of the double cable pull assembly of FIG. 1A shown engaging a second cable.

Referring to FIG. 1D, the release mechanism 110 is shown after the pull rod 120 is released after the first pull. In the illustrated embodiment, the selector lever end 131 is guided to the second feature 137 of the linkage 134. In the second feature 137, the selector lever end 131 is guided to engage with the cable attachment end 119 of the second cable attachment 118. When the pull rod 120 is translated via the pull cable, the selector lever 130 is pulled upwardly and the cable attachment end 119 is pulled upwardly due to engagement with the selector lever end 131. Accordingly, a second cable attached to the second cable attachment 118 is pulled and any latch attached thereto is released. After the pull rod 120 is released, the selector lever end 131 travels along the lower portion of the profile 136 of the linkage 134 to return to the first feature 135. In the illustrated embodiment, the return spring 140 urges the linkage 134 back to an initial position.

Advantageously, by utilizing the double cable pull assembly 100, a single pull cable attached to the pull rod 120 via the pull cable attachment 114 can actuate a first latch attached to the first cable attachment 116 and a second latch attached to the second cable attachment 118. Therefore, a double latch system can be utilized without requiring a user to pull two cables.

Figure 2A:
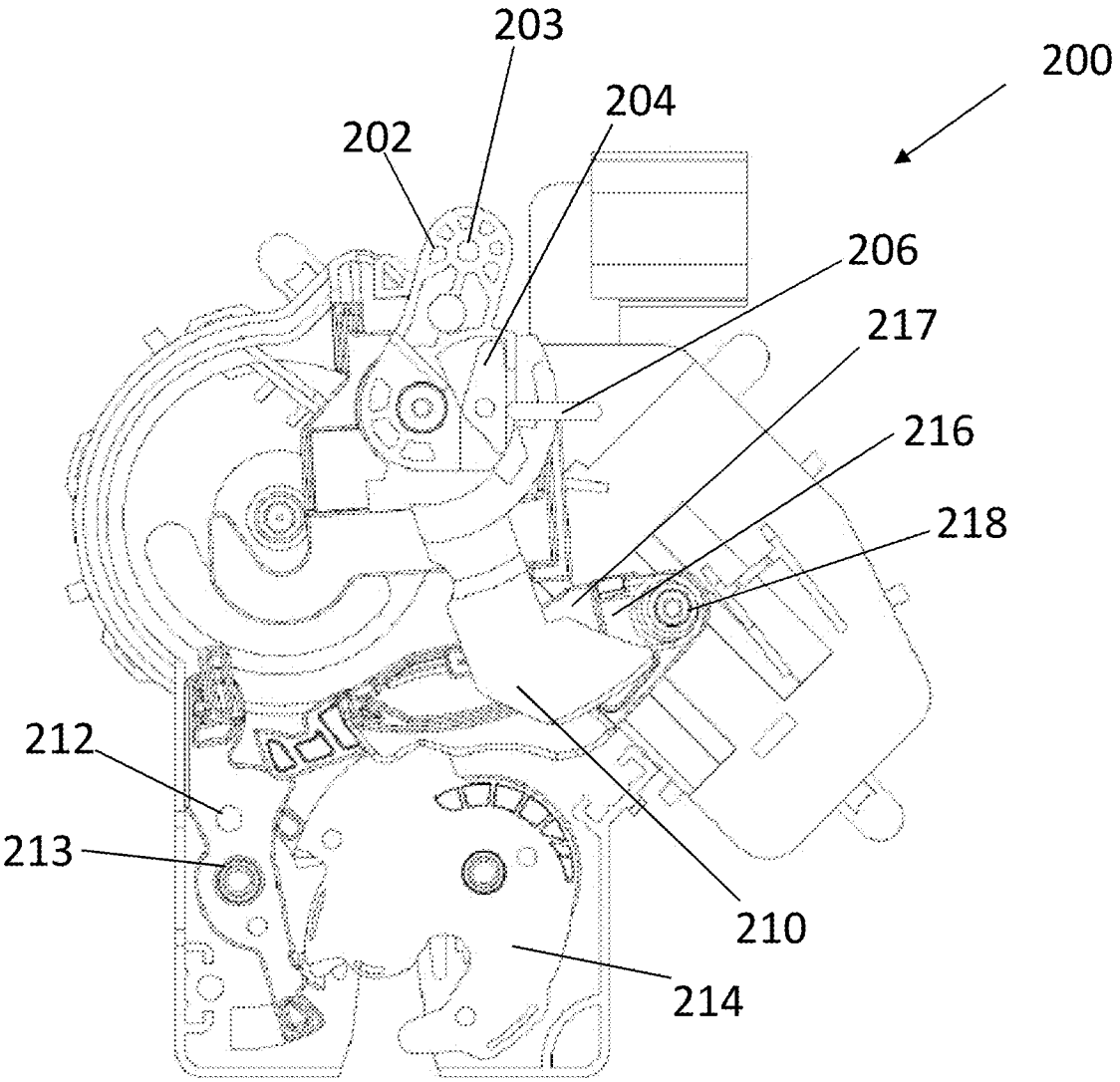
FIG. 2A is a partial cross sectional view of a double pull latch assembly in accordance with this disclosure shown in an open position.

Referring to FIG. 2A, a double pull latch assembly 200 is shown. In the illustrated embodiment, the double pull latch assembly 200 includes a release arm 202, a release arm ratchet 204, a hold open lever 216, a lever 210, and a release latch 214. In the illustrated embodiment, the double pull latch assembly 200 can be utilized to release the release latch 214 after the release arm 202 is actuated twice, requiring the user to pull a cable or handle twice before the double pull latch assembly 200 is released.

In the illustrated embodiment, the release arm 202 includes a cable attachment pivot 203. In the illustrated embodiment, the release arm 202 can be actuated by a cable or handle or any other suitable actuator attached to the cable attachment pivot 203. In the illustrated embodiment, the user rotates the release arm 202 via a first pull to move the lever 210 to a first position and then rotates the release arm 202 via a second pull to move the lever 210 to a second position and release the release latch 214.

In the illustrated embodiment, the release arm 202 rotation is adjusted by the release arm ratchet 204. The release arm ratchet 204 is toggled by the ratchet engagement protrusion 206. Therefore, during a first pull of the release arm 202, the release arm ratchet 204 is in a first cam position, limiting the rotation of the release arm 202. The first pull of the release arm 202 can further toggle the cam position of the release arm ratchet 204, as the release arm ratchet 204 engages with the ratchet engagement protrusion 206. As the release arm ratchet 204 position is toggled to the second cam position, the release arm 202 can be rotated a second rotation amount.

In the illustrated embodiment, the lever 210 rotates to actuate the release latch 214. In the illustrated embodiment, the lever 210 can rotate due to the rotation of the release arm 202. In the illustrated embodiment, at the end of the rotational travel of the lever 210, the lever 210 can disengage the pawl 212 that locks the release latch 214.

In the illustrated embodiment, the release latch 214 can be locked or unlocked by the pawl 212 and a spring 213. As the lever 210 reaches the end of its travel, for example when the release arm 202 is pulled the second time, the pawl 212 can be unlocked by the travel of the lever 210. The release latch 214 can then be released to be actuated. A spring 213 can return the pawl 212 to the original locked position.

In the illustrated embodiment, the hold open lever 216 can hold the lever 210 in an intermediate position. The hold open lever 216 includes a protrusion 217 and a hold open pivot 218. In the illustrated embodiment, the protrusion n 217 can selectively engage the lever 210 to hold the lever 210 in an intermediate position. In the illustrated embodiment, the hold open lever 216 can rotate about the hold open pivot 218 to allow the protrusion 217 to engage the lever 210. In certain embodiments, the lever 210 can be held by the protrusion 217 after the release arm 202 is pulled for the first time and before the release arm 202 is pulled for the second time.

Referring to FIG. 2A, the double pull latch assembly 200 is shown in a resting position. In the resting position, the release arm 202 has not been pulled via a cable or handle, the release arm ratchet 204 is in a first position, the lever 210 is in a resting position, and the pawl 212 has locked the release latch 214.

Figure 2B:
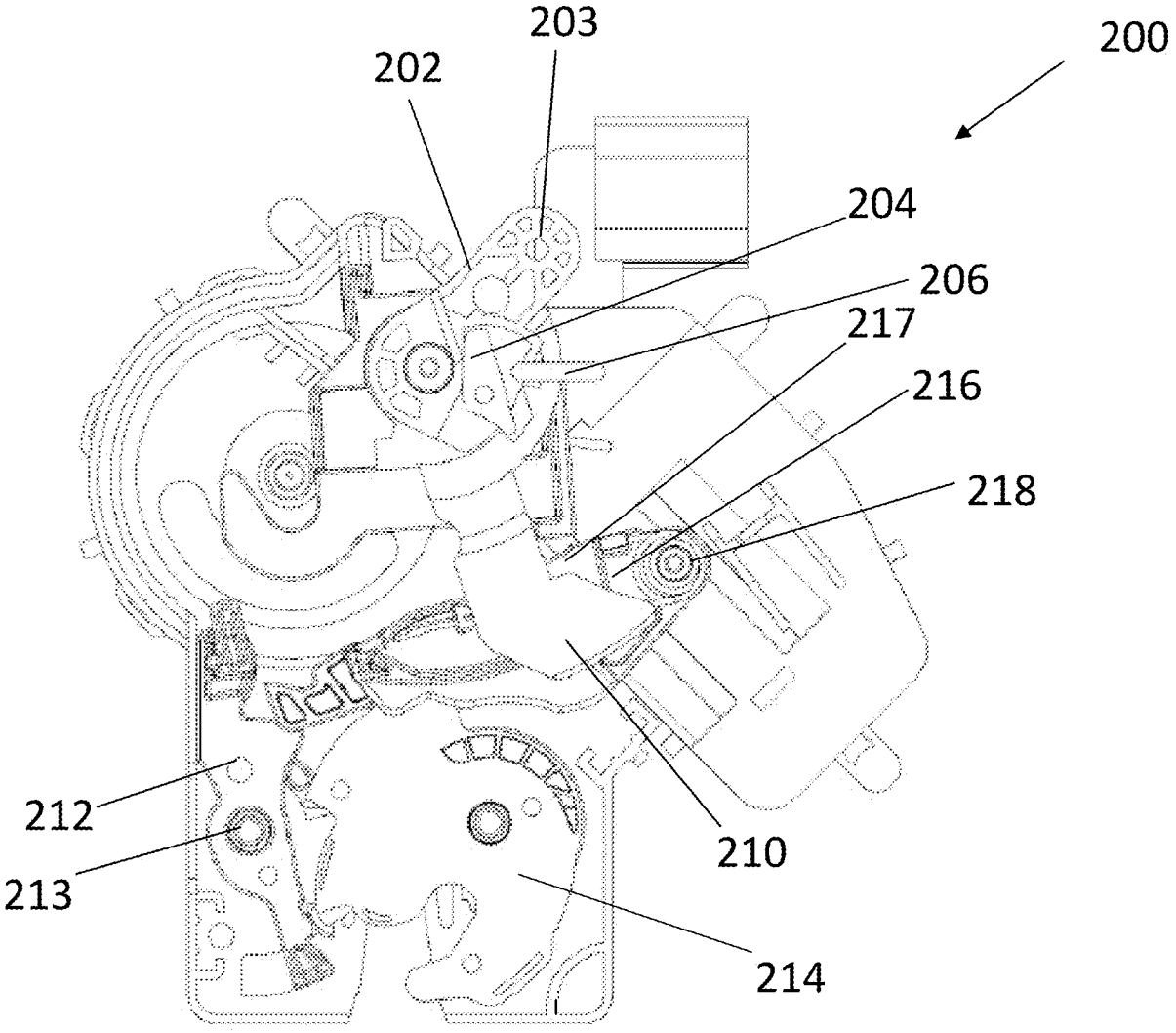
FIG. 2B is a partial cross sectional view of the double pull latch assembly of FIG. 2A shown in a pre-travel position.

Referring to FIG. 2B, the double pull latch assembly 200 is shown in a pretravel position. In the pretravel position, the release arm 202 is pulled via a cable or handle attached to the cable attachment pivot 203. In the illustrated embodiment, the release arm ratchet 204 is moved to a first position.

Figure 2C:
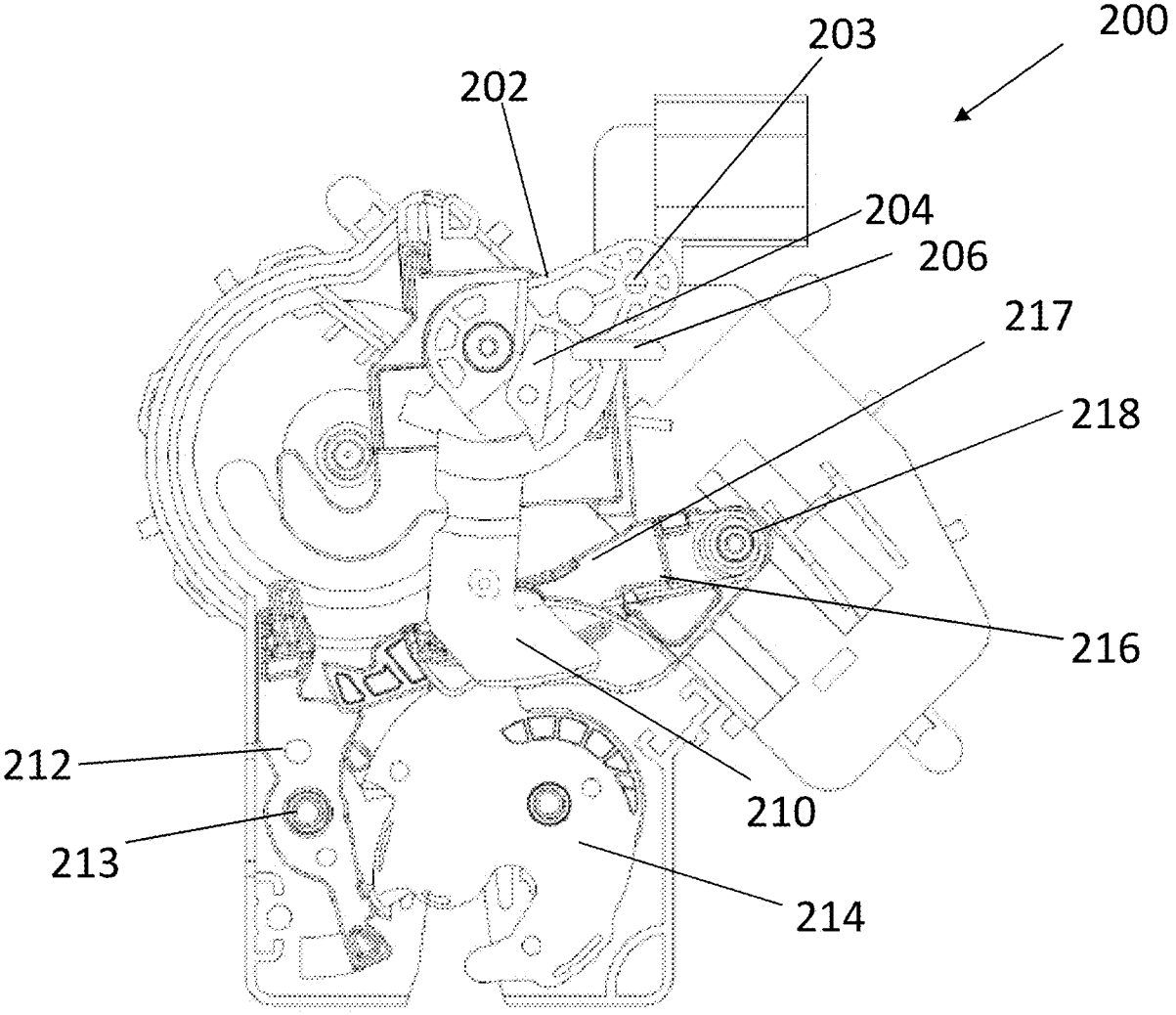
FIG. 2C is a partial cross sectional view of the double pull latch assembly of FIG. 2A shown in a first pull position.

Referring to FIG. 2C, the double pull latch assembly 200 is shown in a first pull position. In the first pull position, the release arm 202 is fully pulled via the cable or handle. The release arm 202 rotates to the arc allowed by the release arm ratchet 204 in the first cam position and moves the lever 210 to the intermediate position. After the user releases the cable or handle to release the release arm 202, the lever 210 rests against the protrusion 217 of the hold open lever 216 in the intermediate position.

Figure 2D:
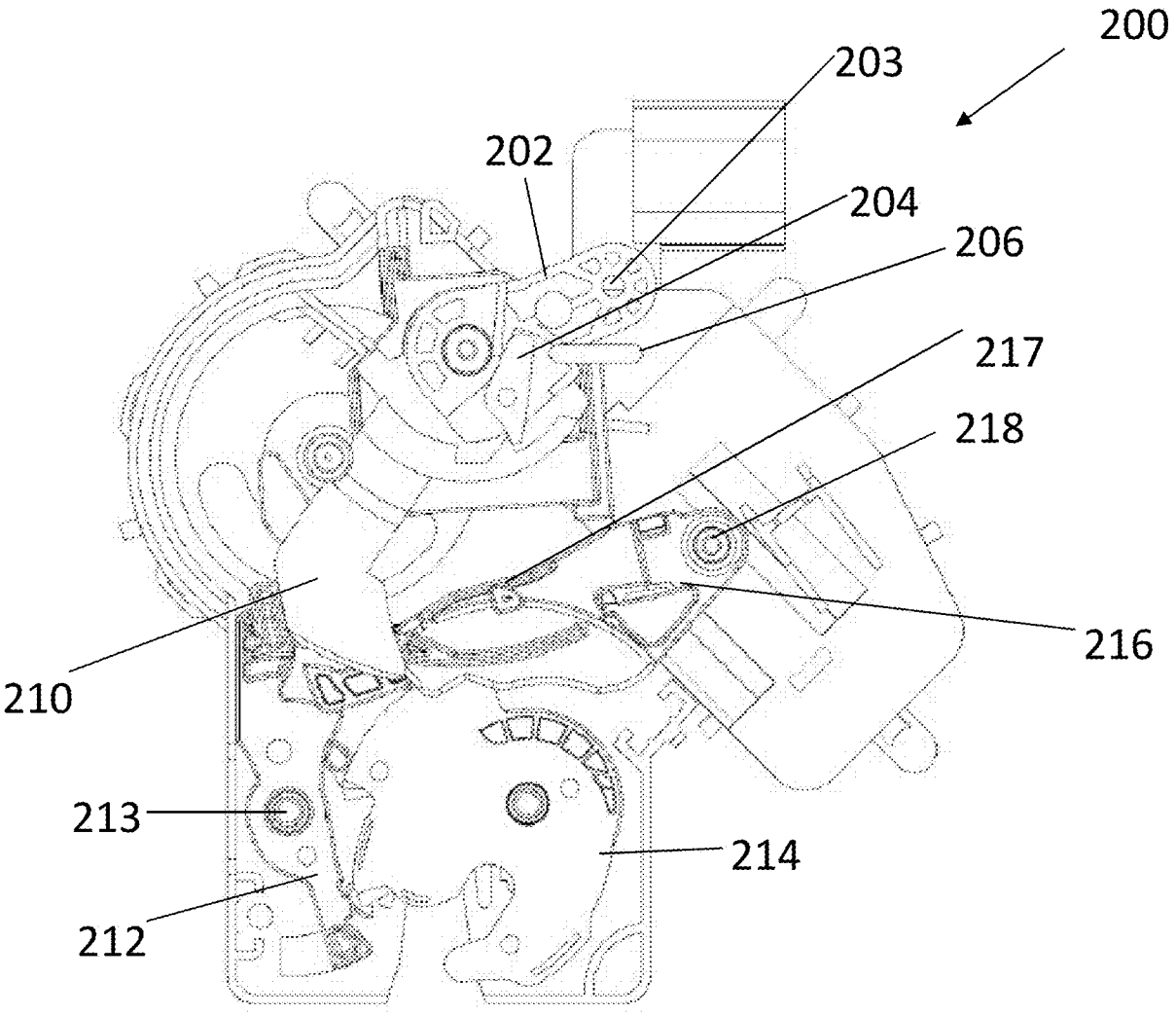
FIG. 2D is a partial cross sectional view of the double pull latch assembly of FIG. 2A shown in a second pull position.

Referring to FIG. 2D, the double pull latch assembly 200 is shown in a second pull position. In the second pull position, the release arm 202 is similarly fully pulled via the cable or handle. However, the release arm 202 rotates to a greater arc, as the release arm ratchet 204 engages a second cam position, to allow the lever 210 to travel the full arc to a release position to contact the pawl 212. As the lever 210 contacts the pawl 212, the release latch 214 is unlocked. In the illustrated embodiment, after the release arm 202 is released, the lever 210 returns to an initial resting position. Similarly, the spring 213 allows the pawl 212 to move to locked position to lock the release latch 214 after the release latch 214 returns to an initial position.

Advantageously, by utilizing the double pull latch assembly 200, a single pull cable can be utilized to first actuate the first action of the double pull latch assembly 200 and then be pulled to actuate the release action of the double pull latch assembly. Therefore, a double latch mechanism can be utilized with a single latch assembly.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A double cable pull assembly configured for use with a double pull latch assembly, comprising:

a pull rod configured to translate between a first position and a second position through application of a force to the pull rod;

a selector lever having a selector lever end, wherein the selector lever is rotatably attached to the pull rod;

a linkage with a first feature and a second feature, wherein the selector lever end is selectively disposed in the first feature or the second feature;

a first cable attachment to receive a first cable;

a second cable attachment to receive a second cable, wherein the first cable and the second cable are configured to perform a respective action when they are actuated by the double pull latch assembly;

wherein, when the pull rod is pulled a first time, the pull rod will move the selector lever to engage the first feature to rotate the linkage in a first direction, pulling the first cable attachment;

wherein after the pull rod is pulled a first time, the selector lever is disposed about the second feature of the linkage; and wherein, when the pull rod is pulled a second time, the pull rod will move the selector lever to engage the second feature to rotate the linkage in a second direction, pulling the second cable attachment.

2. The double cable pull assembly of claim 1, further comprising a pull rod spring associated with the pull rod to urge the pull rod to the first position.

3. The double cable pull assembly of claim 1, further comprising a selector lever pivot to rotatably couple the selector lever to an end of the pull rod.

4. The double cable pull assembly of claim 1, wherein the linkage includes a linkage profile to guide the selector lever end.

5. The double cable pull assembly of claim 1, wherein the first cable attachment includes a first cable attachment engagement feature to receive the selector lever end.

6. The double cable pull assembly of claim 1, wherein the second cable attachment includes a second cable attachment engagement feature to receive the selector lever end.

7. The double cable pull assembly of claim 1, further comprising a return spring associated with the linkage to rotate the linkage to a first position.

8. The double cable pull assembly of claim 1, wherein a pull cable is operatively secured to the pull rod.

9. The double cable pull assembly of claim 1, wherein the pull rod is operatively secured to an actuator.

10. The double cable pull assembly of claim 1, wherein the pull rod is pulled by a user pulling a pull cable operatively coupled to the pull rod.

11. A method of operating a double cable pull assembly configured for use with a double pull latch assembly, comprising:

translating a pull rod between a first position and a second position through application of a force to the pull rod;

linking a selector lever rotatably attached to the pull rod to a first feature of a linkage when the pull rod is pulled a first time such that a first cable is operatively coupled to the pull rod;

linking the selector lever a second feature of the linkage when the pull rod is pulled a second time after the first time such that a second cable is operatively coupled to the pull rod; and wherein the first cable and the second cable are configured to perform a respective action when they are actuated by the double pull latch assembly.

12. The method as in claim 11, wherein a pull cable is operatively secured to the pull rod.

* * * * *